United States Patent [19]

Smith, deceased

[11] 3,963,292

[45] June 15, 1976

[54] WIRING DEVICE WITH SELF-GROUNDING ELEMENT

[75] Inventor: Clarence M. Smith, deceased, late of Trumbull, Conn., by Mary M. Smith, executrix

[73] Assignee: Westinghouse Electric Corporation, Pittsburgh, Pa.

[22] Filed: June 27, 1972

[21] Appl. No.: 266,791

[52] U.S. Cl. ..... 339/14 R

[51] Int. Cl.[2] ..... H01R 3/06

[58] Field of Search ..... 174/51; 339/14 L, 14 P, 339/14 R

[56] References Cited

UNITED STATES PATENTS

| | | | |
|---|---|---|---|
| 3,206,705 | 9/1965 | Smith | 339/14 R |
| 3,617,611 | 11/1971 | Kuether | 174/51 |
| 3,671,916 | 6/1972 | Opalenik | 339/14 R |
| 3,680,031 | 7/1972 | Schumacher | 339/14 R |
| 3,723,942 | 3/1973 | Dennison | 339/14 R |

*Primary Examiner*—Roy D. Frazier
*Assistant Examiner*—Robert A. Hafer
*Attorney, Agent, or Firm*—G. H. Telfer

[57] ABSTRACT

A wiring device, such as a receptacle, for mounting in a metal wall box is provided with a grounding element secured to the metal mounting yoke for the device, preferably by the same fastener that secures an internal contact element to the yoke. The contact portion of the grounding element extends partly across the fastener aperture in the yoke, or a perpendicular projection of the aperture, for electrically contacting the fastener that secures the yoke within the wall box and to complete an electrical path from the yoke to the wall box. Alternatively, the grounding element makes direct contact to a surface of the wall box rather than to the fastener.

4 Claims, 8 Drawing Figures

WIRING DEVICE WITH SELF-GROUNDING ELEMENT

BACKGROUND OF THE INVENTION

This invention relates to wiring devices such as receptacles and switches such as those in common usage in commercial establishments and households.

Wiring devices are frequently mounted in metal wall boxes and for this purpose normally have a metal mounting yoke that supports the insulating housing containing the device elements. In certain instances it is appropriate, and sometimes necessary, that the metal mounting yoke be in good electrical contact with the metal wall box which in turn is connected to a good electrical ground.

For example, duplex receptacles such as those shown and described in Howells U.S. Pat. No. 3,032,736, May 1, 1962, are the type of device for which an electrical path between the mounting yoke and the box is necessary. Such receptacles are for receiving three pronged plugs including a grounding prong which has to communicate to a good electrical ground. As shown in the Howells patent, a contact element in the housing of the device for receiving the grounding prong of a plug is in secure electrical contact with the mounting yoke. While a metal screw is normally used to secure the yoke to the wall box, the screw may not make good enough electrical contact with the yoke. The yoke is normally a stamped metal member with an aperture in which the screw fastener is loosely passed. While the head of the screw makes some contact with the yoke, there may be too high resistance for effective grounding.

As shown by art such as the Howells patent, positive grounding can be provided by a terminal screw on the yoke to which a wire can be fastened and further connected to the wall box. While quite successful, increasing interest in minimizing time required for installation of wiring devices has led to proposals for "self-grounding" in which the attachment of the yoke to the box by a threaded fastener insures positive grounding. Such devices employ an additional element generally in the nature of some sort of spring for making good contact between the yoke and the screw that holds the yoke to the wall box. Examples of other patents to this general type of device are Muska et al U.S. Pat. No. 3,432,793, Mar. 11, 1969 and Winter U.S. Pat. No. 3,609,213, Sept. 28, 1971. Additionally, there is prior art to self-grounding features that do not rely on communication of the grounding path through the fastener such as Despard U.S. Pat. No. 3,185,760, May 25, 1965 and Kuether U.S. Pat. No. 3,617,611, Nov. 2, 1971.

As noted, the interest in the self-grounding feature rose from a desire to economize in installing costs. It must be further recognized that in the art to which this invention pertains simplicity and economy in the original product design are also of utmost importance. However, none of these objectives can detract from the interest of providing reliability and effectiveness in the product.

The present invention arose from an effort to provide a wiring device with a self-grounding feature obtaining the foregoing objectives of reliability, simplicity and economy.

SUMMARY OF THE INVENTION

In accordance with this invention, a wiring device, such as a receptacle, for mounting in a metal wall box is provided with a self-grounding element preferably secured to the metal mounting yoke of the device by the same fastener that secures an internal contact element to the yoke. In one form, the contact portion of the grounding element extends partly across the fastener aperture in the yoke, or a perpendicular projection of the aperture, for electrically contacting the fastener that secures the yoke within the wall box and completing an electrical path from the yoke to the wall box.

In the preferred form, the grounding element is a strap of conductive metal extending from the fastener (e.g. rivet) holding the internal ground contact of a receptacle to the yoke. The strap is disposed immediately adjacent part of the U-shaped portion of the yoke, and may extend through an aperture in the extended yoke portion, which aperture is proximate the housing. The strap then extends over the extended yoke portion to the fastener aperture and has an extremity with an edge in the aperture, or at least partially in it, for secure electrical engagement with a fastener. In other forms, the edge of the grounding element engaging the fastener may be disposed beneath the laterally extending yoke portion. In still other forms the grounding element may extend away from the housing as a leaf spring that upon fastening of the yoke to the wall box makes pressure contact with a surface of the wall box. In its various forms the invention therefore requires merely a strap-like spring element secured by a single fastener to the device, that preferably being a fastener which is otherwise present. In its preferred forms in which edgewise contact is made between the grounding element and the fastener, the grounding element also serves to retain the fastener in the yoke prior to installation of the wiring device.

THE DRAWINGS

DESCRIPTION OF THE PREFERRED EMBODIMENTS

Figure 1:
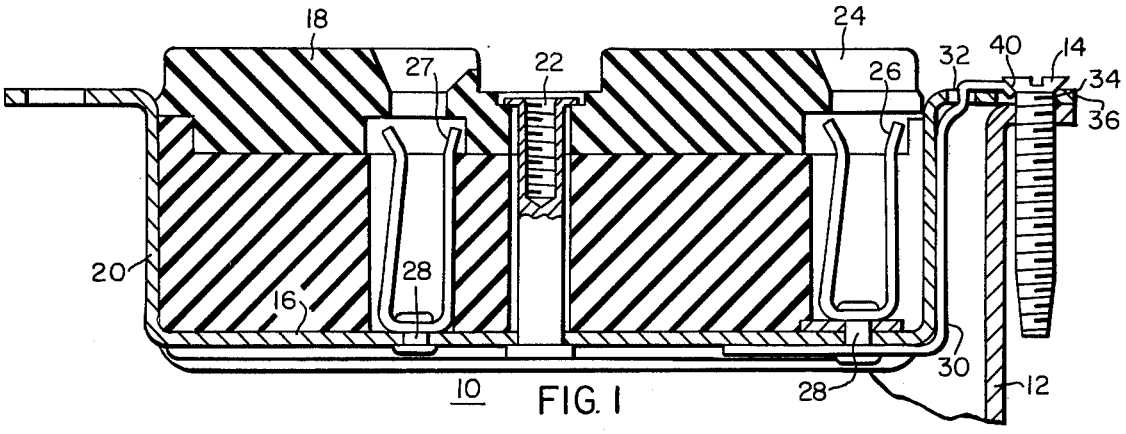
FIG. 1 is a sectional view of the wiring device in accordance with the present invention shown as installed in a wall box.
Figure 2:
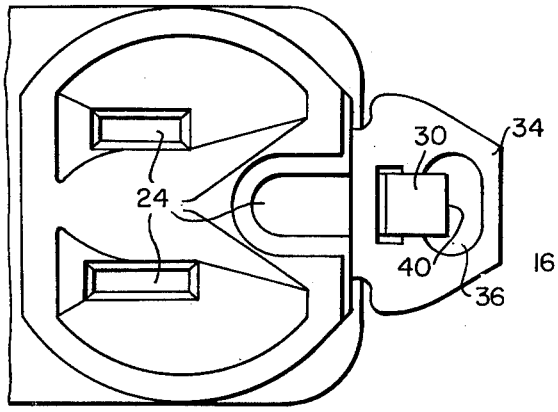
FIG. 2 is a top plan view of part of the wiring device of FIG. 1.
Figure 3:
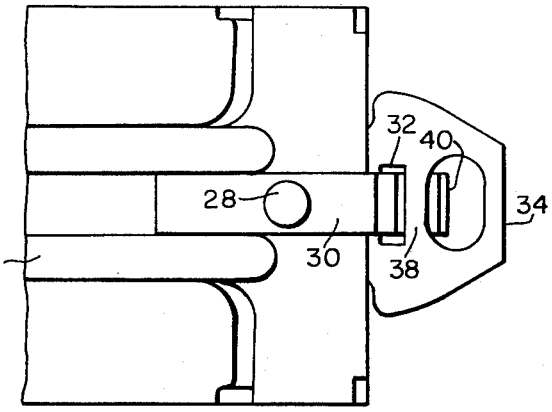
FIG. 3 is a bottom plan view of the portion of the device shown in FIG. 2.

Referring to FIGS. 1, 2 and 3, a wiring device 10 is mounted in a metal wall box 12. In this illustration the wiring device 10 is a duplex receptacle although it will be apparent that the invention may be applied to other types of wiring devices where it is desired to make an electrical contact to the metal wall box.

As has been done in the past, the wiring device 10 is secured to the wall box 12 by screw fasteners 14 which extend through a metal mounting yoke 16 of the device and a flange portion of the wall box. For convenience in illustration, the figures are shown with a horizontal orientation although normally the units are installed in a vertical orientation. Also, the nature of the securing means for the yoke to the wall box is the same at each end of the device, however, it is only necessary to provide a grounding element at one end and thus only one end will be illustrated and described.

The general nature of the duplex receptacle 10 may be as heretofore, such as disclosed in the above-mentioned Howells U.S. Pat. No. 3,032,736. An insulating housing 18 containing appropriate electrical contact elements is positioned within a main U-shaped portion 20 of mounting yoke 16. At the center of the bottom of the U-shaped portion 20 a fastener 22 holds the housing and yoke together.

In the particular device shown, there are apertures 24 in the front face of each portion of the duplex receptacle for the reception of a three-pronged plug, including an aperture for a grounding prong. Within the housing are appropriate female contact elements (not all of which are shown) for mating with the plug prongs. An aperture 24 for an internal grounding contact 26 at the right-hand end of the device is shown as a U-shaped slot in the insulating housing in accordance with the Howells patent. However, the present invention may be applied equally well to devices with fully-enclosed contact slots or the invention may be applied to the grounding contact 27 in the left hand portion which is enclosed by housing elements. Preference is for the element 26 to be associated with this invention because it is closer to the extremity of the yoke.

As the Howells patent discloses, the internal grounding contact members 26 and 27 are directly secured to the metal yoke 16 by conductive fasteners 28 such as rivets, at the bottom of the housing. Now, by reason of this invention, a grounding element 30 is also secured to the yoke 16 by the same fastener 28 as that securing the internal grounding contact 26.

The grounding element 30 is a strap-like conductive element, preferably more conductive than the metal yoke 16 itself. For example, the grounding element 30 may be of phosphor bronze, while the metal yoke 16 is of stainless steel. A substantial portion of the grounding element 30 lies immediately adjacent the U-shaped portion 20 of the yoke. Element 30 need not extend appreciably to the left (in these views) of fastener 28. Element 30 extends partly around the bottom of the U-shaped portion 20 of the yoke up the side of portion 20. It then extends through an aperture 32 in the outwardly extending portion 34 of the yoke which also has fastener aperture 36 for securing the yoke to the wall box. The additional aperture 32 is proximate the housing 18 in relation to aperture 36. Element 30 passes over a portion 38 of the yoke extension 34 and into the area of fastener aperture 36. FIGS. 2 and 3 give top and bottom views of the yoke and grounding element 30 without the presence of the screw 14.

It is preferred that the extremity 40 of the grounding element 30 which engages the screw 14 be originally positioned in a tilted down direction so as to at least partially enter the aperture within the yoke. Upon placement of a screw within the aperture 36, prior to installation, the grounding element 30 will thus maintain the screw in an essentially perpendicular position for proper installation without requiring any washers or the like for screw retention.

Figure 1A:
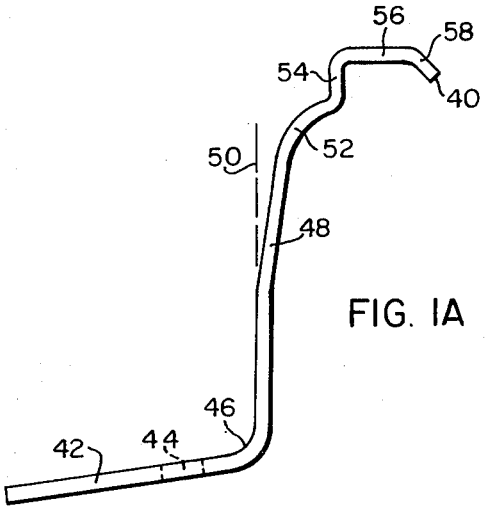
FIG. 1A is a side elevation view of a self-grounding element that may be used in the device of FIG. 1.

FIG. 1A illustrates a preferred form of the grounding element in its originally-shaped form before mounting with the yoke. It includes a bottom portion 42 that is straight and flat and which contains an aperture 44 for securing by fastener 28 with the yoke. A small angle between portion 42 and the horizontal provides spring biasing between the assembled elements. A first bend 46 is made at a relatively small radius conforming with the general curvature of the yoke against which the grounding element 30 is disposed. Proceeding from the first bend 46, the grounding element 30 extends in a generally upright portion 48 partly at a small angle from a vertical line 50. A second bend 52 is provided of a larger radius that the first bend 46, following which is an additional upright portion 54 for a short distance substantially parallel with the first upright portion 48. Then a straight portion 56 proceeds at a right angle to the second upright portion 54. A downturned portion 58 extends from portion 56. Contacting edge 40 is at the extremity of portion 58. This configuration gives the element 30 a spring biasing action against a screw 14 used in fastening device.

Figure 4:
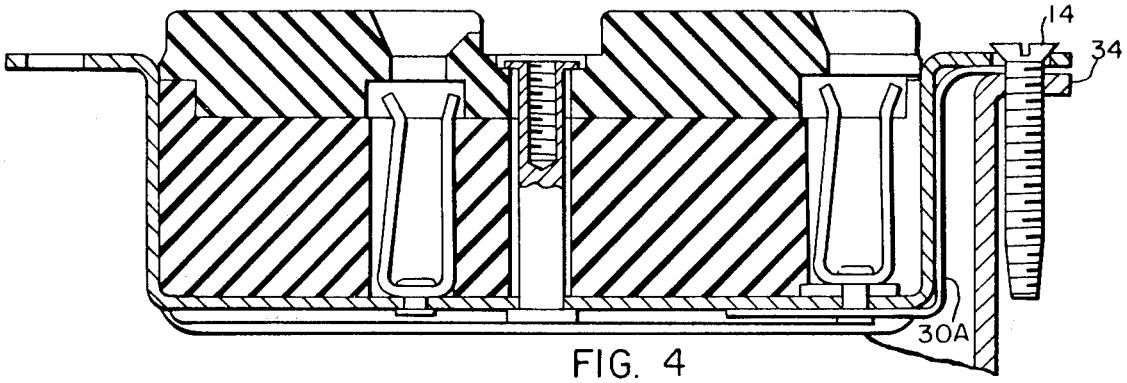
FIGS. 4 and 5 are partial sectional views of alternative embodiments of the invention.
Figure 4A:
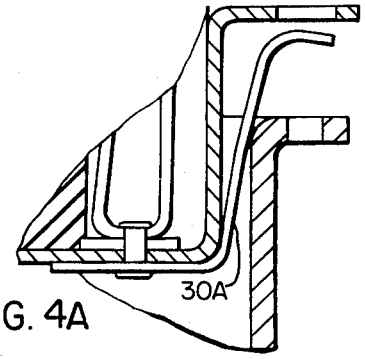
FIGS. 4A and 5A are partial views of the devices of FIGS. 4 and 5, respectively, with grounding elements in partly relaxed positions prior to final installation.

Referring now to FIGS. 4 and 4A, a device as shown in FIG. 1, with otherwise the same features, is provided with a grounding element 30A of somewhat different form in which the grounding element extends around the yoke to a position below the yoke extremity 34 and then laterally extends to engage the side of the fastener 14. FIG. 4A shows the form of this grounding element 30A prior to engagement with screw 14. As can be seen, element 30A is a springlike member which when forced back against the yoke will have spring biasing against the screw 14 extending through the aperture 36. This form of the invention, while useful, is considered generally less convenient than that described in connection with FIGS. 1–3.

Figure 5A:
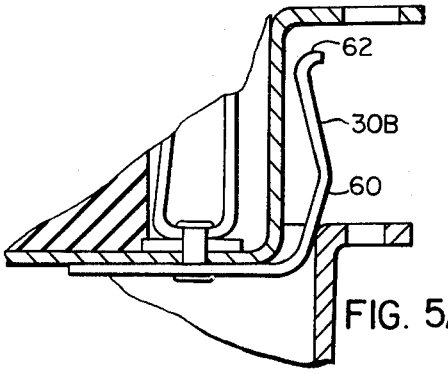
Figure 5:
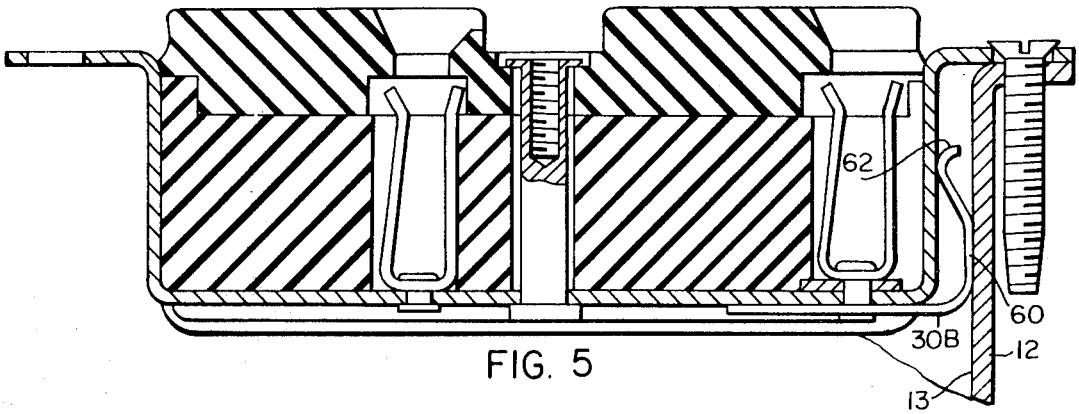

Referring to FIGS. 5 and 5A, an additional form of the invention is illustrated in which a grounding element 30B is similarly disposed in connection with the yoke and the internal grounding contact by the single fastener 28. However, here the grounding element 30B does not communicate through the screw 14 holding the device to the wall box but rather has a bowed out portion 60, as shown in FIG. 5A, originally extending past the edge of a projection fastener aperture so that upon installation, FIG. 5, the surface 13 of the wall box 12 contacts the element 30B and, preferably, forces end 62 into the position shown in FIG. 5 against the yoke. While effective in grounding, the spring-like grounding element 30B may be distorted in handling and also does not provide the feature of holding a fastener within the yoke prior to installation so that additional means such as cardboard washers would have to be used for the latter purpose.

I claim:

1. A wiring device for mounting in a metal wall box and comprising: an insulating housing; a metal mounting yoke secured to said housing, said yoke having a portion extending away from said housing for mounting the device in the wall box with a fastener aperture in said portion; a grounding element of conductive metal secured to said yoke by a fastener that secures an internal contact element to said yoke, said grounding element having a contact portion normally extending at least partly across a perpendicular projection of said fastener aperture; said contact portion of said grounding element comprising an edge extending partly across said aperture projection for making edge contact with the side of a fastener in said aperture and to retain said fastener prior to installation; said yoke having a U-shaped main portion within which said housing is secured and from which said portion extending away from said housing extends, said grounding element comprising a strap disposed immediately adjacent part of said U-shaped main yoke portion, extending through an additional aperture in said extended yoke portion located nearer said housing than is said fastener aperture, extending over said extended yoke portion between said additional aperture and said fastener aperture, and terminating at an extremity having said edge, and said fastener securing said yoke, said internal contact element and said grounding element being located through the bottom of said U-shaped main yoke portion.

2. The subject matter of claim 1 wherein: said wiring device is a receptacle for a three pronged plug and said internal contact element is located to receive the grounding prong of the plug.

3. A wiring device for mounting in a metal wall box and comprising: an insulating housing; a metal mounting yoke secured to said housing, said yoke having a U-shaped main portion within which said housing is located and a laterally extending portion extending away from said housing, said laterally extending portion having an aperture therein for receiving a fastener to secure said yoke to said wall box; a grounding element that is a flat strap-like member of conductive metal having a portion secured to said U-shaped main portion of said mounting yoke, a substantial portion of said grounding element lying flush against said U-shaped main portion with an additional portion of said grounding element extending laterally with an extremity in conductive engagement with a fastener in said aperture; said grounding element extending through an additional aperture in said laterally extending portion of said yoke, said additional aperture being closer to said U-shaped main portion than is said fastener aperture.

4. The subject matter of claim 3 wherein: said grounding element lies flush against part of the bottom of said U-shaped yoke portion and also lies flush against a substantial part of one upstanding side of said U-shaped yoke portion.

* * * * *